United States Patent [19]

Matayoshi et al.

[11] Patent Number: 4,928,650

[45] Date of Patent: May 29, 1990

[54] OPERATING ARRANGEMENT FOR INTERNAL COMBUSTION ENGINE POPPET VALVES AND THE LIKE

[75] Inventors: Yutaka Matayoshi; Toru Yoshimura, both of Yokosuka; Shigeru Kamegaya, Tokyo; Kyugo Hamai, Yokosuka, all of Japan

[73] Assignee: Nissan Motor Co., Ltd., Yokohama, Japan

[21] Appl. No.: 329,846

[22] Filed: May 28, 1989

[30] Foreign Application Priority Data

| | | | |
|---|---|---|---|
| Mar. 28, 1988 | [JP] | Japan | 63-40678[U] |
| Mar. 28, 1988 | [JP] | Japan | 63-40680[U] |
| Mar. 28, 1988 | [JP] | Japan | 63-40681 |
| Mar. 28, 1988 | [JP] | Japan | 63-40684[U] |
| Mar. 29, 1988 | [JP] | Japan | 63-41288[U] |

[51] Int. Cl.[5] ..... F01L 1/30; F01L 1/32

[52] U.S. Cl. ..... 123/90.24; 123/90.28; 123/90.46

[58] Field of Search ..... 123/90.24, 90.25, 90.26, 123/90.28, 90.4, 90.45, 90.46

[56] References Cited

U.S. PATENT DOCUMENTS

| | | | |
|---|---|---|---|
| 2,751,895 | 6/1956 | Gassmann | 123/90.24 |
| 2,814,283 | 11/1957 | Gassmann et al. | 123/90.24 |
| 2,824,554 | 2/1958 | Sampietro | 123/90.28 |
| 2,831,470 | 4/1958 | Lorscheidt | 123/90.24 |
| 2,833,258 | 5/1958 | Lorscheidt et al. | 123/90.24 |
| 4,007,716 | 2/1977 | Jones | 123/90.28 |
| 4,646,690 | 3/1987 | Hayashi | 123/90.46 |
| 4,662,323 | 5/1987 | Moriya | 123/90.4 |

FOREIGN PATENT DOCUMENTS

| | | |
|---|---|---|
| 2805350 | 8/1979 | Fed. Rep. of Germany . |
| 590149 | 12/1924 | France . |
| 1029745 | 12/1950 | France . |
| 53-51928 | 12/1978 | Japan . |
| 60-3412 | 1/1985 | Japan . |
| 60-32910 | 2/1985 | Japan . |
| 60-32911 | 2/1985 | Japan . |
| 61-6611 | 1/1986 | Japan . |
| 61-11408 | 1/1986 | Japan . |
| 242960 | 4/1929 | United Kingdom . |

*Primary Examiner*—Charles J. Myhre
*Assistant Examiner*—Weilun Lo
*Attorney, Agent, or Firm*—Foley & Lardner, Schwartz, Jeffery, Schwaab, Mack, Blumenthal & Evans

[57] ABSTRACT

A first rocker arm is used to induce valve lift while a second one used to move the valve back to closed position. The rocker arms are arranged to engage the valve top or retainer surfaces at locations offset from the axis of the valve and to induce the valve to rotate during the lift and closing operations. Springs, hydraulic lifters or double adjust screw type arrangements are used to control clearances.

16 Claims, 10 Drawing Sheets

OPERATING ARRANGEMENT FOR INTERNAL COMBUSTION ENGINE POPPET VALVES AND THE LIKE

BACKGROUND OF THE INVENTION

1. Field of the Invention

The present invention relates generally to an internal combustion engine and more specifically to a poppet valve control arrangement which reduces the amount of force required to open the valve, reduces the amount of abrasive wear and which induces the same to rotate during operation of the engine in a manner which prolongs the working life of the same.

2. Description of the Prior Art

Poppet valves used in internal combustion engines are usually biased to a closed position using a relatively strong spring and moved against the force of the spring by a cam, or a cam actuated rocker arm. However, with this type of arrangement a relatively large force is required to overcome the spring and lift the valve off its seat.

FIGS. 1 and 2 show two previously proposed arrangements which have attempted to reduce the amount of force which must be applied to open the valves. The arrangement shown in FIG. 1 comprises a cam shaft 1 on which a lift cam 2 and a closure cam 3 are fixedly mounted in a side by side relationship.

A rocker shaft 4 supports a lift rocker arm 5 and a closure rocker arm 6. The lift rocker arm 5 is provided with an adjust screw 7 via which the valve clearance be be adjusted.

A poppet valve 8, which can be either an inlet valve or an exhaust valve, has a stem 8*a* the top of which is provided with a retainer 11. The retainer 11 is formed with a radially extending flange at the bottom thereof which is arranged to be engaged by the leading or outboard end of the closure rocker arm 6. The end of the rocker arm 6 is formed with a U-shaped recess (not shown) which defines two bifurcate finger members. These fingers extend on either side of the valve stem 8*a* and engage the bottom of the retainer 11.

In operation, as the cam shaft 1 rotates, the lift and closure cams 2, 3 rotate to positions wherein the high and low lift portions thereof engage the lift and and closure rocker arm followers 5*a*, 6*a*. This induces the lift rocker arm 5 to rotate in a direction which brings the end of the adjust screw 7 into engagement which the top of the valve stem 8*a* and applies a force which tends to lift the valve head 8*b* off the valve seat 8*c*. Simultaneously, the closure rocker arm 6 is rendered rotatable in the same direction as the lift rocker arm 5, and thus relaxes the force which tends to bias the valve head 8*b* into engagement with the valve seat 8*c*.

Accordingly, the valve head 8*b* is lifted from its valve seat 8*c* and moved to an open position.

As the cam shaft 1 continues the rotate the low lift and high lift portions of the lift and closure cams 2, 3 come into contact with the followers 5*a*, 6*a* of the lift and closure rocker arms 5 & 6, respectively. This causes the closure rocker arm 6 to rotate in a direction which forces the lead end thereof against the lower face of the retainer 11 and produces a force which moves the valve 8 upwardly (as seen in the drawings) and which permits the lift rocker arm 5 to be rotated in the same direction. The valve 8 is thus moved until the valve head 8*b* engages the valve seat 8*c* and closes the valve.

In the FIG. 2 arrangement, the lift rocker arm 15 is arranged to engage a flanged retainer 21 at its leading end and to have a follower 15*a* formed thereon at a location distal from the axis about which it is pivotally mounted. The closure rocker arm 16 is pivotally mounted on the same rocker shaft 14 as the lift one, and provided with a clearance adjust screw 17 which is arranged to engage a portion of the lift rocker arm located proximate the shaft 14 on which the two rocker arms are pivotally mounted.

With this arrangement as the cam shaft rotates essentially the same type of push-pull type of operation which occurs in the FIG. 1 arrangement occurs and the valve is opened and closed.

For further disclosure relating to such types of arrangements, reference can be had to JU-A-61-6611, JP-A-60-32910, JP-A-60-39211 and JU-B-53-51928.

However, the above mentioned arrangements have encountered the problem that, with the passing of time, the valve heads and seats tend to undergo localized wear and/or deterioration. This as well known, leads to the loss of sealing by the valve and invites loss of efficiency and proper engine operation. They have also suffered from the drawback that both of the clearances between the lift and closure rocker arms and the portions of the valve and the retainer which they engage is difficult to set and maintain. Accordingly, these type of arrangements have tended to be noisier than the conventional spring loaded types.

SUMMARY OF THE INVENTION

It is an object of the present invention to provide a valve lift/closure arrangement of the nature disclosed above, which arrangement rotates the valve during engine operation and thus unifies the wear and deterioration which tends to occur between the valve head and seat and therefore prolongs the efficient working life of the same.

It is a further object to provide an arrangement wherein the clearances between the rocker arms and the corresponding surfaces they are arranged to engage, can be controlled in a manner which reduces the amount of noise generated during operation.

In brief, the above objects are achieved by an arrangement or arrangements wherein one rocker arm is used to induce valve lift while a second one used to move the valve back to closed position. In given embodiments the rocker arms are arranged to engage the valve top or retainer surfaces at locations offset from the axis of the valve and to induce the valve to rotate during the lift and closing operations. In other embodiments, springs, hydraulic lifters or double adjust screw type arrangements are used to control clearances.

More specifically, a first aspect of the present invention is deemed to comprise a device having a valve, the valve having a valve stem which is reciprocal along an axis, and which features: a valve operating mechanism comprising: a cam shaft which has first and second cams operatively disposed thereon; first and second pivotally mounted rocker arms, the first and second rocker arms each having first ends which are arranged to engage the first and second cams, respectively; the first rocker arm being operatively connected with the valve in a manner to selective move the same in a first direction which opens the valve when the high lift portion of the first cam engages a first cam follower formed on the first rocker arm; the second rocker arm being operatively connected with the valve in a manner to selective move the same in a second direction which closes the valve when the high lift portion of the second cam engages a second cam follower formed on the second rocker arm; and means for producing a force which acts at a finite distance from the axis and which produces a torque which rotates the valve stem about the axis when the valve is being one of opened and closed.

A second aspect of the present invention is deemed to comprise a device having a valve, the valve having a valve stem which is reciprocal along an axis, the device featuring: a valve operating mechanism comprising: a cam shaft; first and second cams operatively disposed on the cam shaft; first and second pivotally mounted rocker arms, the first and second rocker arms each having first ends which are arranged to engage the first and second cams, respectively; the first rocker arm being operatively connected with the valve in a manner to selective move the same in a first direction which opens the valve when the high lift portion of the first cam engages a first cam follower formed on the first rocker arm; the second rocker arm being operatively connected with the valve in a manner to selectively move the same in a second direction which closes the valve when the high lift portion of the second cam engages a second cam follower formed on the second rocker arm; and clearance adjusting means associated with the first and second rocker arms for reducing the clearance between the first and second rocker arms and the surfaces associated with the valve which are engaged by the first and second rocker arms in order to establish the operative connections.

A third aspect of the present invention is deemed to comprise a device which features a valve, the valve having a valve stem which is reciprocal along an axis and a valve operating mechanism therefore which features: a cam shaft; first and second cams operatively disposed on the cam shaft; first and second pivotally mounted rocker arms, the first and second rocker arms each having first ends which are arranged to engage the first and second cams, respectively; first connection means for interconnecting the first rocker arm and the valve in a manner to selectively move the same in a first direction when the high lift portion of the first cam engages a first cam follower formed on the first rocker arm, and to produce a first force which tends to rotate the valve stem in a first rotational direction; and second connection means for interconnecting the second rocker arm and the valve in a manner to selective move the same in a second direction when the high lift portion of the second cam engages a second cam follower formed on the second rocker arm, and to produce a second force which tends to rotate the valve stem in the first rotational direction.

A fourth aspect of the invention is deemed to comprise a device which features: a valve, the valve having a valve stem which is reciprocal along an axis; a valve operating mechanism comprising: a cam shaft the cam shaft having first and second cams operatively disposed thereon; first and second pivotally mounted rocker arms, the first and second rocker arms each having first ends which are arranged to engage the first and second cams, respectively; the first rocker arm being operatively connected with the valve in a manner to selective move the same in a first direction which opens the valve when the high lift portion of the first cam engages a first cam follower formed on the first rocker arm; the second rocker arm being operatively connected with the valve in a manner to selective move the same in a second direction which closes the valve when the high lift portion of the second cam engages a second cam follower formed on the second rocker arm; a first spring, the first spring being arranged to interconnect the first and second rocker arms, the first spring being arranged to bias the first rocker arm to rotate in a first rotational direction and the second rocker arm to rotate in a second rotational direction which is opposite the first; and a second spring, the second spring being arranged to bias the second rocker arm to rotate in the first rotational direction.

A fifth aspect of the present invention is deemed to comprise a device which features a valve, the valve having a valve stem which is reciprocal along an axis: a valve operating mechanism comprising: a cam shaft the cam shaft having first and second cams operatively disposed thereon; first and second rocker arms, the first and second rocker arms each having first ends which are arranged to engage the first and second cams, respectively; the first rocker arm being operatively connected with the valve in a manner to selective move the same in a first direction which opens the valve when the high lift portion of the first cam engages a first cam follower formed on the first rocker arm; the second rocker arm being operatively connected with the valve in a manner to selective move the same in a second direction which closes the valve when the high lift portion of the second cam engages a second cam follower formed on the second rocker arm; a shaft, the shaft being arranged to be selectively rotatable; a concentric portion formed on the shaft on which the first rocker arm is pivotally mounted; and an eccentric portion formed on the shaft on which the second rocker arm is pivotally mounted.

A sixth aspect of the present invention is deemed to comprise a device which features first and second valves, the first and second valves each having a valve stem which is reciprocal along an axis; a valve operating mechanism comprising: a cam shaft the cam shaft having first and second cams operatively disposed thereon; first and second pivotally mounted rocker arms, the first and second rocker arms each having first ends which are arranged to engage the first and second cams, respectively; the first rocker arm being bifurcate and operatively connected with the first and second valves in a manner to selective move the same in a first direction when the high lift portion of the first cam engages a first cam follower formed on the first rocker arm; the second rocker arm being being bifurcate and operatively connected with the first and second valves in a manner to selective move the same in a second direction when the high lift portion of the second cam engages a second cam follower formed on the second rocker arm; and clearance adjusting means associated with the first and second rocker arms for reducing the clearance between the first and second rocker arms and the surfaces associated with the first and second valves which are engaged by the first and second rocker arms in order to establish the operative connections.

DETAILED DESCRIPTION OF THE PREFERRED EMBODIMENTS

Figure 1:
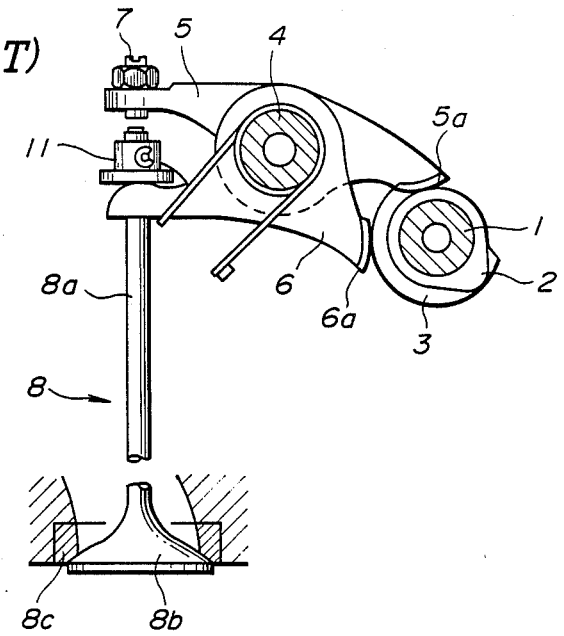
FIG.1 (PRIOR ART)
FIGS. 1 and 2 show the prior art arrangements which have been discussed in the opening paragraphs of the instant disclosure.
Figure 2:
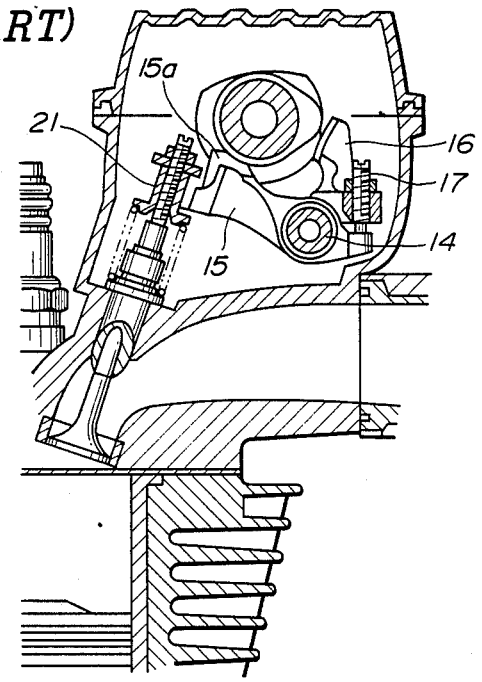
FIG.2 (PRIOR ART)
Figure 3:
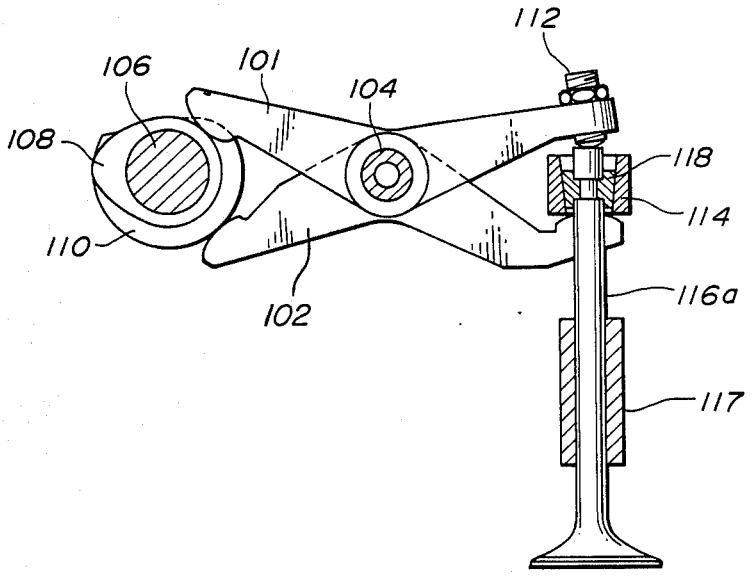
FIG. 3 is a side elevational view, partially in section, showing a first embodiment of the present invention.
Figure 4:
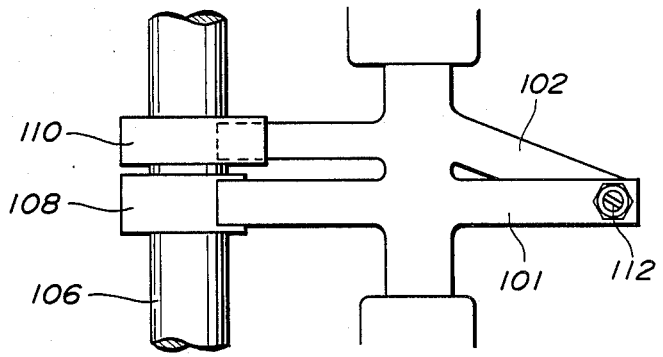
FIG. 4 is a plan view of the arrangement shown in FIG. 3.

FIGS. 3 to 6 show details of a first embodiment of the present invention. In this arrangement, V-shaped lift and closure rocker arms 101, 102 are pivotally mounted on a rocker shaft 104 in a scissor like configuration. A cam shaft 106 has lift and closure cams 108, 110 disposed thereon. Followers formed on the inboard ends of the rocker arms (inboard being taken as meaning the ends of the rocker arms closest the cam shaft 108) are arranged to engage the surfaces of cams 108, 110. The outboard end (viz., the end closest the valve) of the lift rocker arm 101 is provided with a clearance adjust screw 112 while the corresponding end of the closure rocker arm 102 is arranged to engage the lower face of a retainer 114 which is operatively mounted on the upper end of the valve stem **116*a*. In this instance the valve stem is arranged to pass through a valve guide 117**.

According to the present invention, the retainer 114 has a tapered bore formed therein in which a tapered cotter 118 is disposed. The cotter 118 is arranged to engage an annular recess formed near the top of the valve stem in a manner wherein mutual rotation therebetween is prevented.

In this embodiment, the cotter 118 is provided with a key-like projection **118*a* which is received in a key groove-like slot formed in the inner periphery of the retainer 114. This arrangement fixedly interconnects the retainer 114 and the valve stem 116*a*** so that relatively rotation therebetween is prevented.

Figure 5:
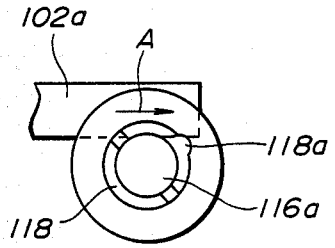
FIG. 5 is a plan view showing the manner in which the closure rocker arm engages the lower face of the retainer and the resulting force which tends to rotate the valve.

As shown in FIG. 5, the outboard end of the closure rocker arm 102 is arranged to have only a single finger portion **102*a*, which portion engages the lower face the retainer 114 on one side of the valve stem. Viz., the closure rocker arm 102 applies a lifting force to the retainer 114 at a location which is offset from the axis of the valve stem 116*a***.

With this arrangement when the valve is lifted toward its closed position by the closure rocker arm 102, the pivotal motion of the arm 102 cause the site where contact between the rocker arm finger **102*a* and the retainer 114 occurs to move by a finite amount in the direction indicated by arrow A. This produces a force which acts at a predetermined distance from the axis of the valve stem 116*a***, and generates a torque which tends to rotate the valve in a clockwise direction (as seen in the drawings).

Figure 6:
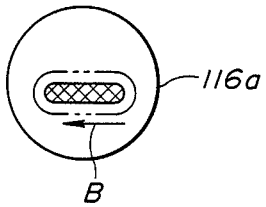
FIG. 6 is a plan view showing the manner in which the clearance adjust screw engages the top of the valve step and the force via which the valve tends to be rotated.

The adjust screw 112 is formed in a manner to engage the top of the valve stem **116*a* at a location which is slightly offset from the axis thereof (see FIG. 6). As the lifting action proceeds, the site where contact between the adjust screw tip and the top of the valve stem occurs, moves along the hatched area in the direction indicated by the arrow B. This produces a force which acts in the same direction and generates a torque which tends to rotate the valve in the same direction as the force A produced by the engagement between the retainer 114 and the finger 102*a* formed at the outboard end of the closure rocker arm 102**.

Accordingly, every time the valve is lifted and closed, the valve is subject to a small amount of rotation. This ensures that the valve head is rotated to a different position with respect to the valve seat each time the valve is opened and closed and unifies the manner in which wear and deterioration of the surfaces which engage to produce the all important seal, takes place.

It will be noted that the amount rotation induced by the engagement between the retainer 114 and the closure rocker arm 102 is greater than in the case of the lift rocker arm 101 and the top of the valve stem **116*a***, as the distance at which the force acts from the axis of the valve stem is larger. Accordingly, the amount of rotation produced during the closure mode is greater than in the case of the lift mode.

As will be appreciated, with the instant embodiment, by applying the lift on only one side of the retainer, the rubbing and abrasion which tends to occur when the closure rocker arm is arranged to engage the bottom of the retainer on both sides of the valve stem is prevented, while the motion of the single finger **102*a*** advantageously induces rotation of the valve little by little.

Figure 7:
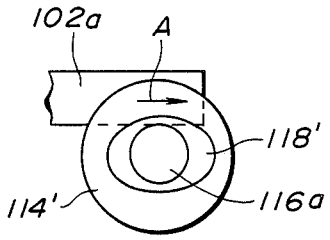
FIG. 7 is a plan view showing a second embodiment of the invention which features the use of non-circular cross-sections to prevent mutual rotation between the valve retainer and a cotter member disposed at the top of the valve stem.

FIG. 7 shows a second embodiment of the present invention wherein the tapered bore formed in the retainer 114' and the cotter 118, are both formed with oval cross-sections. This of course prevents mutual rotation between the retainer, cotter and the valve stem.

Figure 8:
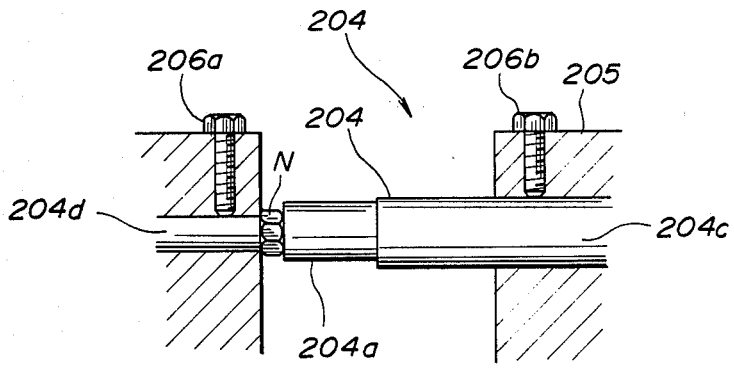
FIG. 8 is a partially sectioned view showing the arrangement which characterizes a third embodiment of the present invention.

FIG. 8 shows a rocker shaft 204 according to a third embodiment of the present invention. In this embodiment the portion of the shaft **204*a* on which the closure rocker arm is supported is arranged to be eccentric with respect to portion of the shaft 204*b* which supports the lift rocker arm and journal portions 204*c*, 204*d* which are supported in bores formed in the cylinder head 205. Lock bolts 206*a*, 206*b* are arranged to engage the small and large diameter journal portions 204*d*, 204*c* and prevent rotation of the rocker shaft 204 when tightened. A nut N is fixedly formed on the shaft 204 and arranged to receive a spanner or the like and to permit the shaft to be selectively rotated when the lock nuts 206*a*, 206*b*** are released.

This arrangement enables the clearance between the outboard end of the closure rocker arm 102 and the lower face of the retainer 114 to be adjusted. Viz., as the portion of the shaft 204*a* on which the closure rocker arm 102 is supported is eccentric, rotation of the rocker shaft 204 enables the above mentioned clearance to be adjusted by changing the position of the axis about which it is rotatable relative to the valve.

The clearance between the lift rocker arm 101 and the top of the valve stem can be adjusted by way of the adjust screw 112.

Apart from the above described rocker shaft construction, the rest of the construction of the third embodiment is essentially the same as that of the first, and as such no further disclosure will be given for brevity.

Figure 9:
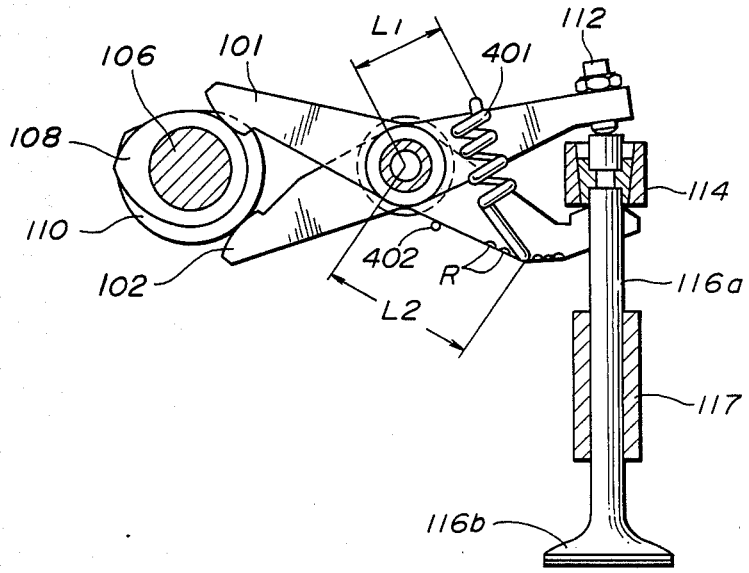
FIGS. 9 and 10 show a fourth embodiment of the present invention.
Figure 10:
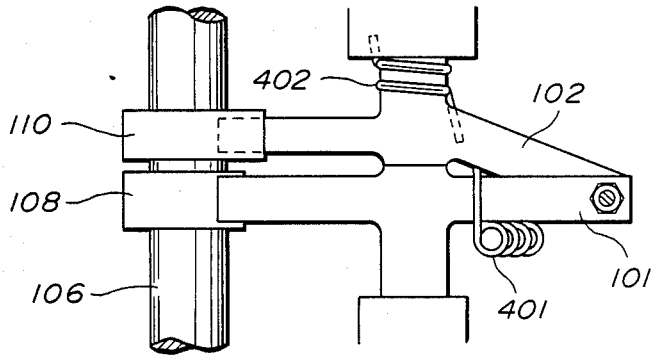

FIGS. 9 and 10 show a fourth embodiment of the present invention. This embodiment features the provision of first and second springs 401, 402. In this case the first spring 401 comprises a tension spring having a predetermined power which is connected at a first end to the lift rocker arm 101 at a distance L1 from the axis of the rocker shaft, and to the closure rocker arm 102 at a distance L2 from said axis. The lower surface of the closure rocker arm 102 is formed with a plurality of recesses R which are formed at predetermined intervals and which enable the first spring 401 to selectively connected thereto. This enables the adjustment of the bias acting between the two arms.

The second torsion spring 402 is wound around the boss of the closure rocker arm 102 and arranged to engage the lower surface of the same and the cylinder head in a manner to apply a bias to the arm 102 to rotate in a direction which moves the outboard end of the same toward the lower face of the retainer 114.

The effect of the two springs 401, 402 is such that the second spring 402 moves the outboard end of the closure rocker arm 102 into contact with the lower face of the retainer 114 thus reducing the clearance therebetween to zero while the first spring 401 draws the adjust screw 112 of the lift rocker arm down into engagement with the top of the valve stem 116*a* thus reducing the clearance therebetween to zero.

In brief, the rocker arms 101, 102 are biased in a manner to sandwich the top of the valve stem 116*a* and the bottom of retainer 114 therebetween. The sandwiching effect also tends to occur at the inboard ends which engage the lift and closure cams 108, 110. By manipulating the adjust screw 112 the clearances between the cams 108, 110 can be set to levels suitable in view of the thermal expansion which tends to occur as a result of the sliding contact which occurs therebetween.

Accordingly, with the instant embodiment, despite various dimensional deviations which tend to occur from unit to unit and the changes in dimensions due to wear, U zero clearances are constantly maintained at the outboard ends of the rocker arms 101, 102 with a controlled amount of bias. This reduces the noise during operation.

Further, particularly during low speed modes of engine operation, as the first spring 401 applies a greater torque to the closure rocker arm 102 than to the lift arm 101, when the valve 116 is closed, the additional torque applied to the closure arm 102 ensures that via reaction the valve head 116*b* is held against the seat with sufficient force to ensure that the leakage does not occur.

Figure 11:
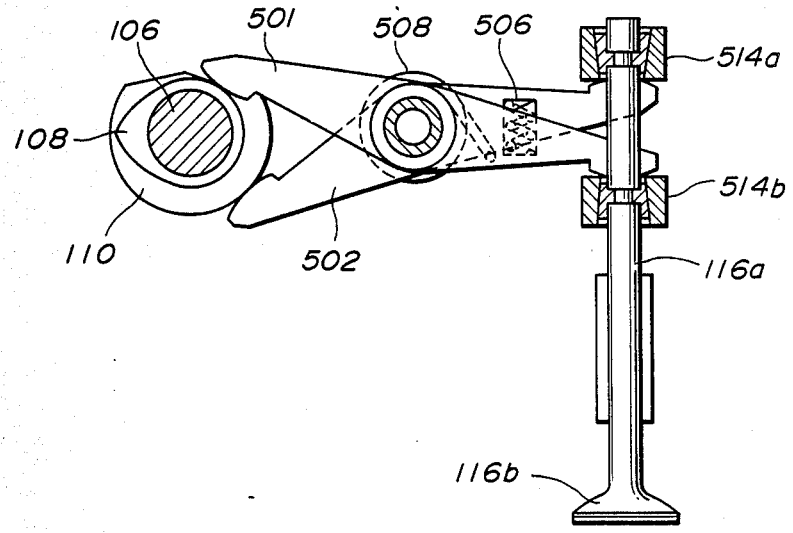
FIGS. 11 and 12 show a fifth embodiment of the present invention.
Figure 12:
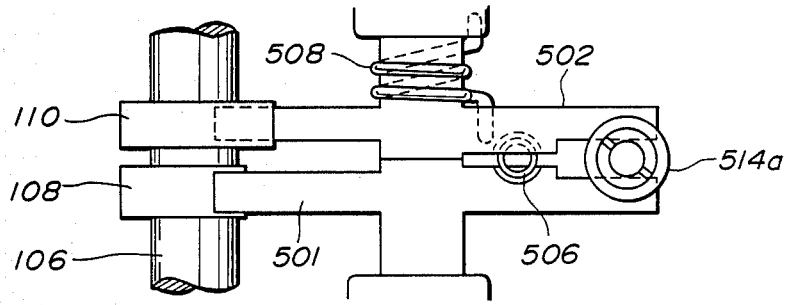

FIGS. 11 and 12 show a fifth embodiment of the present invention. In this embodiment the valve stem is provided with two retainer units 514*a*, 514*b* which are inverted in the illustrated manner. The lift rocker arm 501 is arranged to press down on top of the lower retainer 514*b* while the closure arm 502 is arranged to engage the lower face of the upper retainer 514*a*. These engagement are such as to cause the valve 116 to be rotated in the same direction each time a lift and a closure operation take place. The amount of rotation in this instance is essentially equal.

A compression spring 506 is disposed between the two relatively straight arms 501, 502 in the illustrated manner and arranged to bias the outboard ends of the two rocker arms toward engagement with the respective retainers 514*a*, 514*b*. In this embodiment a torsion spring 508 is arranged in the same manner as in the case of the fourth embodiment.

The operation of the fifth embodiment is essentially similar to that of the previous.

Figure 13:
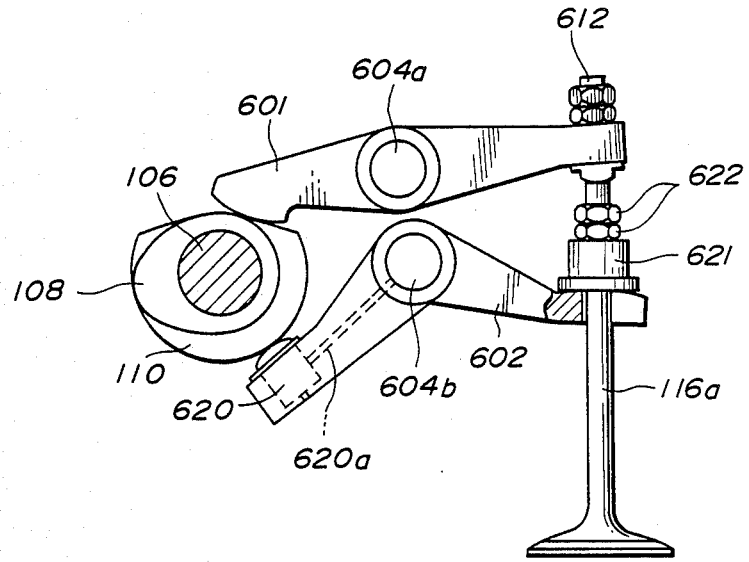
FIGS. 13 and 14 shows a sixth embodiment of the present invention.
Figure 14:
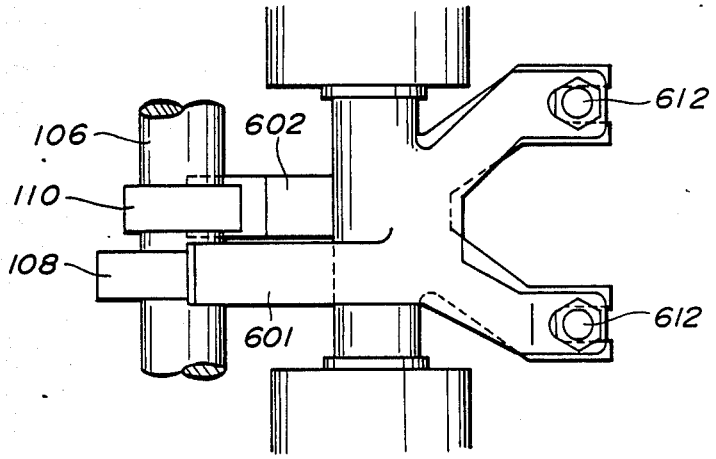

FIGS. 13 and 14 show a sixth embodiment of the present invention. The embodiment is directed to simultaneously controlling two inlet or exhaust valves and thus features the use of Y shaped rocker arms.

In this arrangement the lift and closure rocker arms 601, 602 are supported on separate rocker shafts 604*a*, 604*b* and the inboard end of the closure rocker arm 602 is provided with a hydraulic lifter 620. This lifter 620 is, as shown, arranged to support the follower which engages the closure cam 110 and to be supplied with hydraulic fluid by way of a passage structure which includes a bore 620*a* formed through the portion of the rocker arm 602 which extends inboard from the rocker shaft 604*b*. In this arrangement the rocker shaft 604*b* is arranged to be at least partially hollow and to be suitably apertured in a manner hydraulic fluid can be pumped into the hollow of the rocker shaft and in part transferred to the lifter 620 via the bore 620*a*.

The valve stem 116*a* is provided with a thread on its upper portion on which an adjust collar 621 is disposed. The position of this collar on the shaft is adjusted by rotating adjust nuts 622. The adjust screws 612 on the lift rocker arm are provided with double lock nuts in this case.

Figure 15:
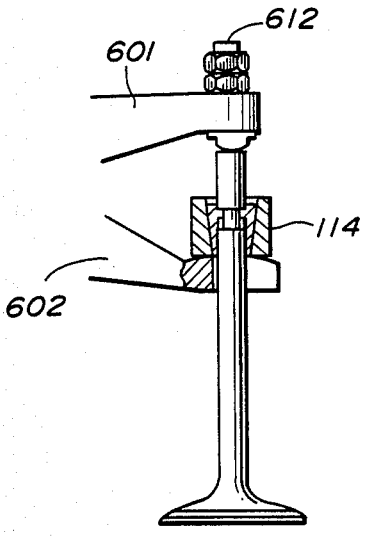
FIG. 15 is partially sectioned view showing a seventh embodiment of the invention.

FIG. 15 shows a seventh embodiment of the present invention. This embodiment is essentially the same as that shown in FIGS. 13 and 14 and differs in that the adjust collar is replaced with a retainer arrangement 114 of the nature utilized in the first embodiment.

Figure 16:
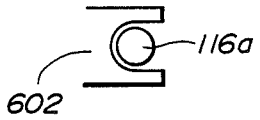
FIG. 16 is a view as taken along section line B—B of FIG. 13.
Figure 17:
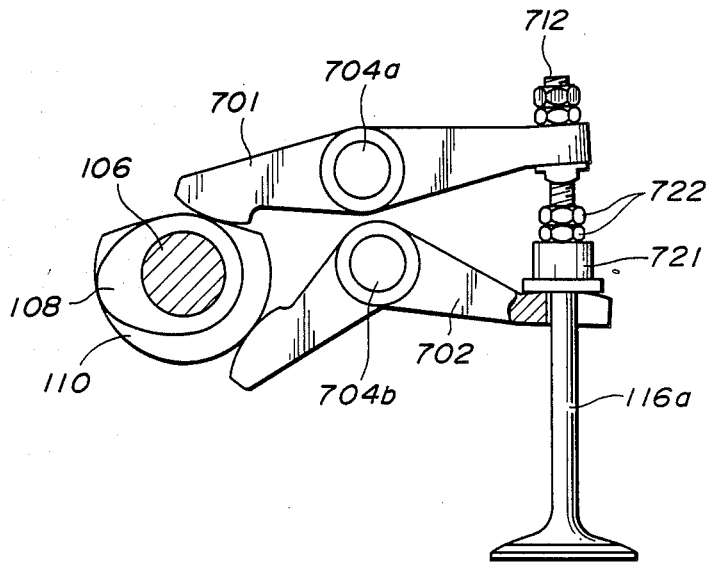
FIGS. 17 and 18 show an eighth embodiment of the present invention.
Figure 18:
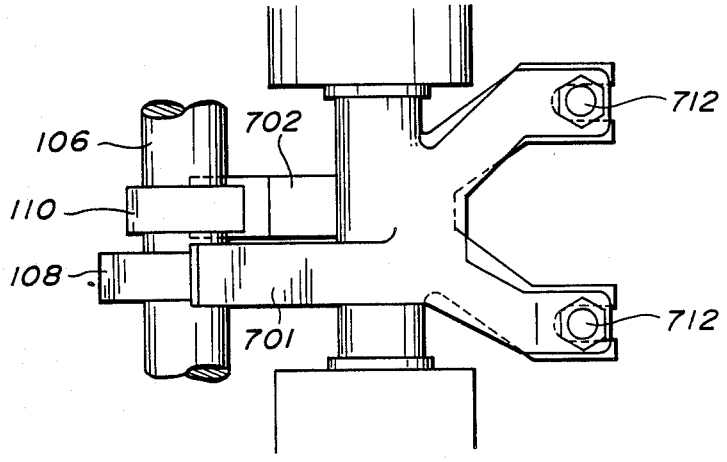
Figure 19:
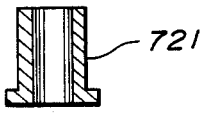
FIGS. 19 and 20 are sectional views showing constructional features of the eighth embodiment.
Figure 20:
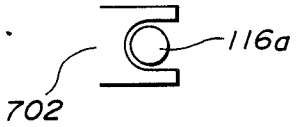

As shown in FIG. 16, the outboard ends of the bifurcate closure rocker arm in the sixth and seventh embodiments are provided with a U.shaped recess and thus two support fingers which engage the lower face of the retainer. Of course it is within the scope of the present invention to use a single finger type arrangement in a manner which will induce rotation of the valve stem during closure operations.

FIGS. 17 to 20 show an eighth embodiment of the present invention. This embodiment is basically similar to the arrangement shown in FIGS. 13 and 14 and differs basically in that the hydraulic lifter is omitted in a manner which simplifies the construction and assembly of the arrangement.

As will be appreciated, the present invention is not limited to any one of the disclosed embodiments. The various modifications and/or combinations which can be made will be apparent to those skilled in the art to which the present invention pertains.

Merely by way of example, the portions of the shafts on which the rocker arms are pivotally mounted in the embodiments shown in FIGS. 13 to 18 could be rendered eccentric in place of the adjust screw type clearance adjustment arrangements.

Alternatively, the hydraulic lifter arrangement utilized in the embodiment shown in FIG. 13 could be provided in both of the rocker arms of that embodiment or included in one or both of the rocker arms of the embodiment shown in FIGS. 1–6; or springs of the nature used in the embodiments shown in FIGS. 9–12 could be added to the embodiments shown in 13 to 20, and so on.

What is claimed is:

1. In a device having a valve, said valve having a valve stem which is reciprocal along an axis:

a valve operating mechanism comprising:

a cam shaft, said cam shaft having first and second cams operatively disposed thereon;

first and second pivotally mounted rocker arms, said first and second rocker arms each having first ends which are arranged to engage said first and second cams, respectively;

said first rocker arm being operatively connected with said valve in a manner to selectively move the same in a first direction which opens the valve when the high lift portion of said first cam engages a first cam follower formed on said first rocker arm;

said second rocker arm being operatively connected with said valve in a manner to selectively move the same in a second direction which closes the valve when the high lift portion of said second cam engages a second cam follower formed on said second rocker arm; and means for producing a force which acts as a finite distance from said axis and which produces a torque which rotates said valve stem about said axis when the valve is being one of opened and closed.

2. A device as claimed in claim 1, further comprising:

clearance adjusting means associated with said first and second rocker arms for reducing the clearance between said first and second rocker arms and the surfaces associated with said valve which are engaged by said first and second rocker arms in order to establish said operative connections.

3. A device as claimed in claim 1, further comprising:

clearance adjusting means formed on said valve for reducing the clearance between said first and second rocker arms and the surfaces associated with said valve which are engaged by said first and second rocker arms in order to establish said operative connections.

4. A device as claimed in claim 1, further comprising:

a hydraulic lifter, said hydraulic lifter being disposed in said second rocker arm and arranged to support a follower which engages said second cam, said hydraulic lifter being supplied with hydraulic fluid under pressure via a passage structure including a bore formed in said second rocker arm, said bore leading from said hydraulic lifter to a passage formed in a shaft on which said second rocker arm is pivotally mounted.

5. In a device having a valve, said valve having a valve stem which is reciprocal along an axis:

a valve operating mechanism comprising:

a cam shaft said cam shaft having first and second cams operatively disposed thereon;

first and second rocker arms, said first and second rocker arms each having first ends which are arranged to engage said first and second cams, respectively;

said first rocker arm being operatively connected with said valve in a manner to selectively move the same in a first direction which opens the valve when the high lift portion of said first cam engages a first cam follower formed on said first rocker arm;

said second rocker arm being operatively connected with said valve in a manner to selectively move the same in a second direction which closes the valve when the high lift portion of said second cam engages a second cam follower formed on said second rocker arm;

a shaft, said shaft being arranged to be selectively rotatable;

a concentric portion formed on said shaft on which said first rocker arm is pivotally mounted; and an eccentric portion formed on said shaft on which said second rocker arm is pivotally mounted.

6. A device as claimed in claim 5, further comprising:

clearance adjusting means associated with said first and second rocker arms for reducing the clearance between said first and second rocker arms and the surfaces associated with said valve which are engaged by said first and second rocker arms in order to establish said operative connections.

7. A device as claimed in claim 5, further comprising:

clearance adjusting means formed on said valve for reducing the clearance between said first and second rocker arms and the surfaces associated with said valve which are engaged by said first and second rocker arms in order to establish said operative connections.

8. A device as claimed in claim 5, further comprising:

a hydraulic lifter, said hydraulic lifter being disposed in said second rocker arm and arranged to support a follower which engages said second cam, said hydraulic lifter being supplied with hydraulic fluid under pressure via a passage structure including a bore formed in said second rocker arm, said bore leading from said hydraulic lifter to a passage formed in a shaft on which said second rocker arm is pivotally mounted.

9. In a device having a valve, said valve having a valve stem which is reciprocal along an axis:

a valve operating mechanism comprising:

a cam shaft;

first and second cams operatively disposed on said cam shaft;

first and second pivotally mounted rocker arms, said first and second rocker arms each having first ends which are arranged to engage said first and second cams, respectively;

first connection means for interconnecting said first rocker arm and said valve in a manner to selectively move the same in a first direction when the high lift portion of said first cam engages a first cam follower formed on said first rocker arm, and to produce a first force which tends to rotate said valve stem in a first rotational direction; and second connection means for interconnecting said second rocker arm and said valve in a manner to selectively move the same in a second direction when the high lift portion of said second cam engages a second cam follower formed on said second rocker arm, and to produce a second force which tends to rotate said valve stem in said first rotational direction.

10. A device as claimed in claim 9, further comprising:

a hydraulic lifter, said hydraulic lifter being disposed in said second rocker arm and arranged to support a follower which engages said second cam, said hydraulic lifter being supplied with hydraulic fluid under pressure via a passage structure including a bore formed in said second rocker arm, said bore leading from said hydraulic lifter to a passage formed in a shaft on which said second rocker is pivotally mounted.

11. A device as claimed in claim 9, further comprising:

clearance adjusting means associated with said first and second rocker arms for reducing the clearance between said first and second rocker arms and the surfaces associated with said first and second connecting means are engaged by said first and second rocker arms in order to establish said interconnections.

12. A device as claimed in claim 9, further comprising:

clearance adjusting means formed on said valve for reducing the clearance between said first and second rocker arms and the surfaces associated with said first and second connecting means which are engaged by said first and second rocker arms in order to establish said interconnections.

13. In a device having a valve, said valve having a valve stem which is reciprocal along an axis:

a valve operating mechanism comprising:

a cam shaft said cam shaft having first and second cams operatively disposed thereon;

first and second pivotally mounted rocker arms, said first and second rocker arms each having first ends which are arranged to engage said first and second cams, respectively;

said first rocker arm being operatively connected with said valve in a manner to selective more the same in a first direction which opens the valve when the high lift portion of said first cam engages a first cam follower formed on said first rocker arm;

said second rocker arm being operatively connected with said valve in a manner to selective move the same in a second direction which closes the valve when the high lift portion of said second cam engages a second cam follower formed on said second rocker arm;

a first spring, said first spring being arranged to interconnect said first and second rocker arms, said first spring being arranged to bias said first rocker arm to rotate in a first rotational direction and said second rocker arm to rotate in a second rotational direction which is opposite the first; and a second spring, said second spring being arranged to bias said second rocker arm to rotate in said second rotational direction.

14. A device as claimed in claim 13, further comprising:

clearance adjusting means associated with said first and second rocker arms for reducing the clearance between said first and second rocker arms and the surfaces associated with said valve which are engaged by said first and second rocker arms in order to establish said operative connections.

15. A device as claimed in claim 13, further comprising:

clearance adjusting means formed on said valve for reducing the clearance between said first and second rocker arms and the surfaces associated with said valve which are engaged by said first and second rocker arms in order to establish said operative connections.

16. A device as claimed in claim 13, further comprising:

a hydraulic lifter, said hydraulic lifter being disposed in said second rocker arm and arranged to support a follower which engages said second cam, said hydraulic lifter being supplied with hydraulic fluid under pressure via a passage structure including a bore formed in said second rocker arm, said bore leading from said hydraulic lifter to a passage formed in a shaft on which said second rocker arm is pivotally mounted.

* * * * *